United States Patent [19]

Leasure et al.

[11] 4,173,106

[45] Nov. 6, 1979

[54] CARTON FORMING METHOD

[75] Inventors: William Leasure; Luis Garcia; Charles Reifel; Jack Shelton, all of Houston, Tex.

[73] Assignee: Mira-Pak Inc., Houston, Tex.

[21] Appl. No.: 930,523

[22] Filed: Aug. 3, 1978

Related U.S. Application Data

[60] Continuation of Ser. No. 787,062, Apr. 13, 1977, which is a continuation-in-part of Ser. No. 570,504, Apr. 22, 1975, Pat. No. 4,027,579, which is a division of Ser. No. 614,903, Sep. 19, 1975, Pat. No. 4,024,693.

[51] Int. Cl.[2] ..... B65B 5/04

[52] U.S. Cl. ..... 53/449; 53/451; 53/467; 53/170

[58] Field of Search ..... 53/449, 451, 170, 171, 53/173, 174, 467

[56] References Cited

U.S. PATENT DOCUMENTS

| | | | |
|---|---|---|---|
| 2,826,881 | 3/1958 | Negoro | 53/252 X |
| 3,306,001 | 2/1967 | Peppler | 53/449 |
| 3,380,222 | 4/1968 | Bergmann et al. | 53/449 |
| 3,724,163 | 4/1973 | Roussel | 53/171 |
| 3,983,682 | 10/1976 | Scully | 53/170 X |

*Primary Examiner*—Travis S. McGehee

*Attorney, Agent, or Firm*—Larson, Taylor and Hinds

[57] ABSTRACT

A method is disclosed for opening a folded paper box blank, inserting a product filled container into the opened blank, and closing and sealing the end flaps of the blank. The apparatus for carrying out the method comprises a magazine for storing a vertical pile of the folded blanks, separating cams and feeding rollers for discharging the lowest blank, elongate transport screws, a transfer plate for standing up the discharged blank and delivering the blank to the transport screws, and a cylindrical cam for engaging the sides of the folded blank and, upon rotation thereof, for compressing and hence opening the folded blank thereby forming an opened rectangular box. The apparatus also comprises an endless conveyer system that includes a plurality of carrier trays, each tray for securely holding an opened box and conveying the box to a plurality of stations where the end flaps are folded in and sealed.

4 Claims, 49 Drawing Figures

262
264
228
248
250
265
214
216

214
252
256
230
244
246
260
258

220
22
216
240
246
226
228
238
214
232
248
256
230
238
226
246
242
250
252
244
224
234
265
218
234
238
230
224
244
254

CARTON FORMING METHOD

CROSS REFERENCE TO RELATED APPLICATIONS

This is a continuation, of application Ser. No. 787,062 filed Apr. 13, 1977 which is a continuation-in-part application of an application filed on Apr. 22, 1975 and having Ser. No. 570,504 now U.S. Pat. No. 4,027,579 and is a division of application Ser. No. 614,903, filed Sept. 19, 1975 now U.S. Pat. No. 4,024,693.

BACKGROUND OF THE INVENTION

1. Field of the Invention

The present invention relates generally to carton forming apparatus and relates in particular to a carton former that utilizes folded box blanks and which opens the blank, inserts a package into the opened blank, and closes and seals the end flaps.

2. Description of the Prior Art

Modern package manufacturing and packaging techniques have developed to a state whereby the package material is usually manufactured by a first company, and the package is manufactured and printed by a second company. One type of package which is usually made and filled in this manner is the conventional paper box comprised of an outer light cardboard carton and an inner paper bag that contains the product being sold. Potato chips, crackers, pretzels, and cookies are one type of product that is packaged in the aforementioned manner.

Occasionally the manufacturer of the product has purchased the packaging machinery which conventionally consists of a first type of machinery for manufacturing and filling the soft bags and a second type of machinery for manufacturing the outer cardboard boxes and inserting the paper bags in the boxes. Many of the conventional machines are extremely expensive, heavy, require a large amount of floor space, and are comprised of a large number of interrelated and complicated elements that are prone to frequent failure. In addition, the conventional packaging equipment has a relatively slow package per minute rate and those capable of higher packages per minute rates have relatively large down times.

One type of packaging equipment uses cardboard cartons that are manufactured as folded box blanks and which are purchased by the producer of the contents being packaged. The folded box blanks are purchased in stacks and, once opened, can be quickly and efficiently filled with a previously filled bag. The use of folded box blanks by the producer of the contents eleminates the necessity for having the expensive equipment for manufacturing the outer carton. However, the folded box blanks still must be opened so that the formed carton is ready to receive the filled bag. Many of the prior art devices for opening the folded box blanks comprise a plurality of mechanical fingers connected to a plurality of carriers. The carriers are moved through a series of complex motions in order to select one folded box blank, open the box blank, and position it for receipt of the filled bag. These devices are prone to frequent breakdowns and are often very difficult to interface with other mechanical equipment. As a result, additional complex apparatus is often necessary for receiving the opened box blank and for positioning it for receiving the filled bag.

SUMMARY OF THE INVENTION

The present invention overcomes the aforementioned disadvantages and provides a versatile and efficient carton forming and filling apparatus that can operate at high speeds. A device in accordance with the present invention requires relatively little floor space and has a high degree of realiability, integrity, and flexibility. Such a device is completely automatic and produces a finished, sealed package having an outer cardboard carton and an inner filled bag. The complex and expensive interfacing equipment which is common with conventional machines is no longer required. As a result, the present invention provides a relatively inexpensive relatively maintanance-free and relatively simple device for forming cartons from folded box blanks.

A device in accordance with the present invention can easily be used in combination with a flexible bag type package forming apparatus. Flexible bags can be formed and filled with conventional package forming apparatus such as that disclosed in the following U.S. Patents of William C. Leasure: U.S. Pat. Nos. 3,027,696; 3,543,467; 3,548,563; and 3,785,112. The combination of a device in accordance with the present invention with the aforementioned flexible bag forming apparatus provides a system for forming and filling flexible bags, placing the bags in opened boxes, sealing the box, and delivering a completed package.

The present invention provides a device for forming a carton from folded box blanks and comprises a means for supplying a plurality of the folded box blanks, a rotatable cam means for engaging and opening the box blanks, means for depositing a filled flexible bag into the open box blank, and means for closing and sealing the end flaps of the box blank thereby forming a sealed carton. In one embodiment of the invention, the cam means for opening supplied folded box blanks includes a first cam means for receiving the blanks and for opening the received blanks upon the rotation thereof and a second cam means for cooperating with the first cam means for opening the received blanks. In one example of the invention, the first and second cam means each respectively comprises a substantially cylindrical cam, the first cam having an axially progressing spiral cam surface whereby a folded blank is received at a first end of the first cam and is engaged along one edge thereof by the cam surface. In another embodiment of the present invention, the means for supplying folded box blanks include a storage magazine containing a vertical stack of folded box blanks, a disc means for separating the bottom blank from the vertical stack of blanks and a rotatably mounted feed roller for receiving and advancing the separated box blank. In a further embodiment of the present invention, the box closing and sealing means comprises a carrier means for receiving a bag containing box blank from the depositing means, for securely holding the box blank, and for delivering a sealed box blank; a conveyor means for conveying the carrier means to a plurality of longitudinally spaced stations; a dust flap closure means located at one station for closing the dust flaps at each end of the box blanks; seal end flap closure means located at another station for closing the seal end flaps at each end of the box blank; and sealing means located at still a further station for sealing the seal end flaps.

Other details, features and objects of the present invention are set forth in, or apparant from, the accompanying drawings and detailed description of the preferred embodiment found hereinbelow.

BRIEF DESCRIPTION OF THE DRAWINGS

FIGS. 3A and 4A showing the separator at the initial or 0° position; FIGS. 3B and 4B showing the separator at the 90° position; FIGS. 3C and 4C showing the separator at the 180° position; FIGS. 3D and 4D showing the separator at the 270° position; and FIGS. 3E and 4E showing the separator at the 360° position.

FIG. 5A showing the cam in the initial or 0° position; FIG. 5B showing the cam in the 90° position; FIG. 5C showing the cam in the 180° position; FIG. 5D showing the cam in the 270° position; and FIG. 5E showing the cam in the 360° position.

FIG. 6A showing the cam in the initial or 0° position; FIG. 6B showing the cam in the 90° position; FIG. 6C showing the cam in the 180° position; FIG. 6D showing the cam in the 270° position; and FIG. 6E showing the cam in the 360° position.

FIG. 12 being a plan view of a carrier tray shown in the open position and ready for receiving an opened and filled box blank. FIG. 13 is a plan view of a stationary elongate cam having a surface such that when the cam follower of the carrier tray shown in FIG. 12 is in engagement therewith, the carrier tray will be rotated 90° as shown in FIG. 14. FIG. 14 is a plan view of the carrier tray depicted in FIg. 12, (not shown) in the closed position in which a box blank can be sucurely held in position; and FIG. 14 is a plan view of a cam for rotating the carrier tray shown in FIG. 14 to the position shown in FIG. 12.

FIG. 15A showing the carrier tray in the initial or 0°, opened position; FIG. 15B shows the carrier tray of FIG. 15A with an opened box blank positioned longitudinally therein; FIG. 15C shows the carrier tray rotated 45°; and FIG. 15D shows the carrier tray rotated 90°.

FIG. 16A showing the relative position of the box blank and stationary guides for tucking in the leading dust flaps; FIG. 16B showing the leading dust flaps being tucked in; FIG. 16C showing the rear dust flaps being tucked in the FIG. 16D showing both dust flaps tucked in and held in position.

FIG. 19A showing the box in a first position; FIG. 19B showing the box rotated 45°; and FIG. 19C showing the box rotated 90° and the carrier tray in the opened position.

DETAILED DESCRIPTION OF THE PREFERRED EMBODIMENTS

Figure 1:
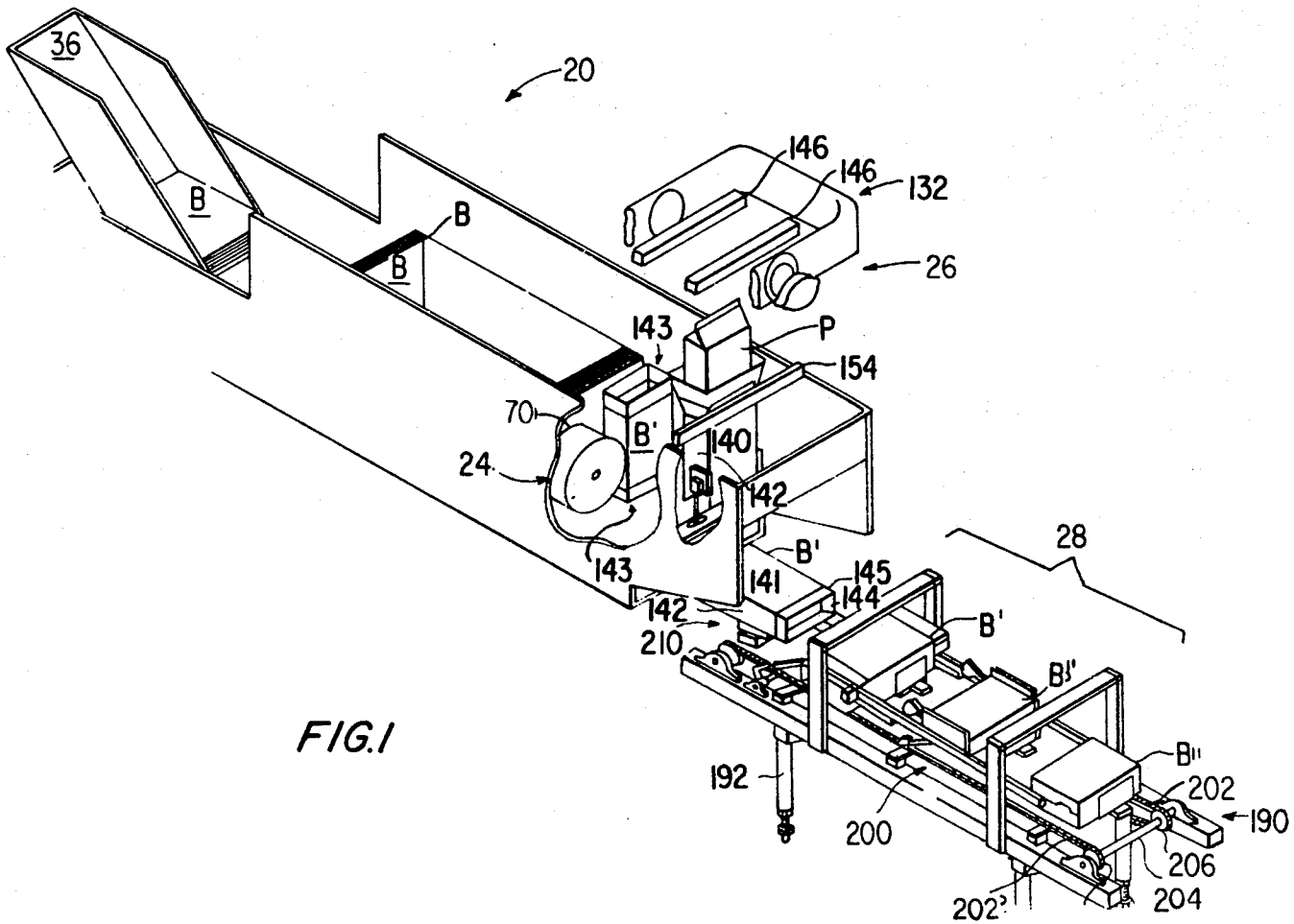
FIG. 1 is a perspective view with parts cut away of a carton forming apparatus in accordance with one embodiment of the invention.

With reference to the figures in which like numerals depict like elements, a carton forming apparatus 20 in accordance with one embodiment of the invention is shown in FIG. 1. Apparatus 20 can be thought of as being comprised of four major components, a supplying means 22 for supplying a plurality of folded box blanks B, a forming means that includes a rotatable cam means 24 for engaging folded box blanks B and for opening the box blank to form an opened box blank or carton B', filling or depositing means 26 for inserting a flexible package or bag P into opened box blank B', and means for closing and sealing the end flaps of the opened box blank B' and thereby forming a sealed carton B''.

SUPPLYING MEANS

Figure 2:
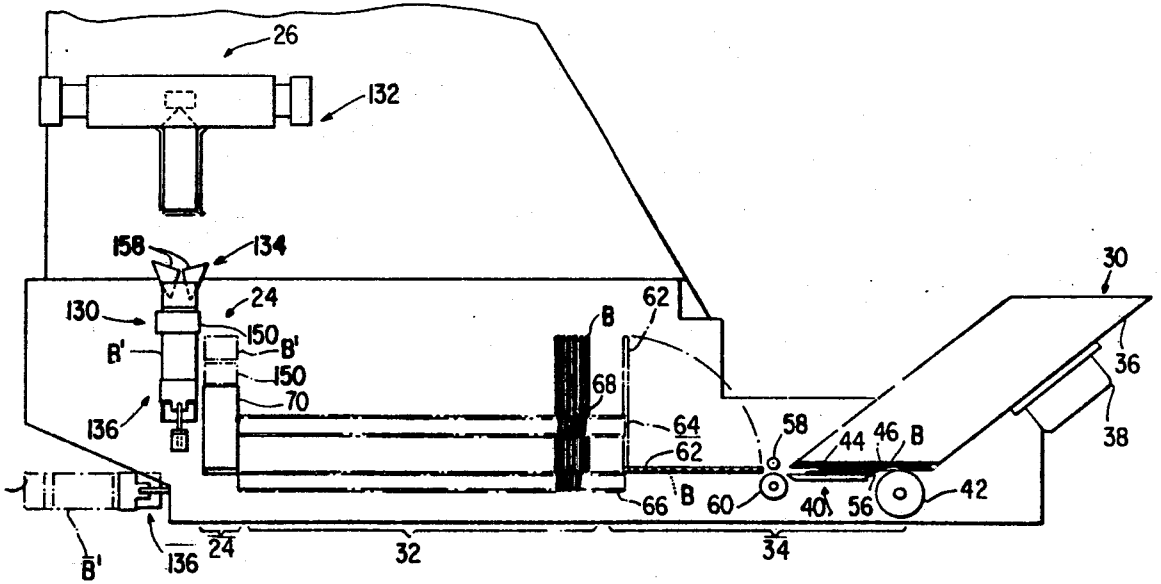
FIG. 2 is a side elevational view of part of the embodiment of the invention shown in FIG. 1.

With reference to FIGS. 1 and 2, supplying means 22 comprises a storage means for magazine 30 for storing a vertical stack of folded box blanks B, a transporting means 32 for transporting box blanks B to cam means 24, and transfer means 34 for transferring folded box blanks B from magazine 30 to transporting means 32. Magazine 30 is a hopper-type magazine for storing a plurality of folded box blanks B in a vertical stack or pile and for providing for the feeding of one box blank at a time from the bottom. Magazine 30 comprises a slanted back 36 and vibrator 38 directly mounted onto back 36. Vibrator 38 ensures that the plurality of stacked box blanks B are advanced downwardly as the bottom blank is fed from magazine 30.

Transfer means 34 comprises a rotatable disc means 40 for separating the bottom folded box blank B from the vertical stack and a means for advancing and feeding the separated box blank from magazine 30 comprising a rotatably mounted feed roller 42. With further reference to FIGS. 3 and 4, the feed roller 42 is a cylindrical roller which extends substantially the transverse width of magazine 30 and is rotatably mounted at the rearward part of the bottom of magazine 30. Disc means 40 is comprised of two sets of discs, each set of discs including a rotatably mounted vertical axle 44, a generally oval-shaped top disc 46 and a generally oval-shaped bottom disc 48. Discs 46 and 48 have a shape and are mounted on axle 44 such that, as shown in plan view in FIG. 3, the outermost edges of the combined discs substantially form a virtual circle. However, at one of the ends 50 of bottom disc 48, a section 52 protrudes beyond the virtual circle and is for supporting the bottommost box blank as the bottommost box blank is being separated from the next box blank in the stack. The corresponding end section of top disc 46 to end section 52 (denoted 54) has a reduced thickness so as to form a knife-like edge thereby permitting easier separation of the bottommost box blank from the next box blank in the stack. Below disc means 40 is a guide plate 56 for guiding a separated box blank as the box blank is advanced by the rotating feed roller 42.

Transfer means 34 further comprises a pair of loader rollers 58 and 60 and a pivotable loading plate 62 which is positionable between a first, horizontal position and a second, vertical position. Loader rollers 58 and 60 are rotatably mounted horizontal rollers with loader roller 58 being smaller than loader roller 60 and located vertically thereabove forming a nip therebetween. The vertical height of the nip between loader rollers 58 and 60 is the same as the the vertical height of the top of guide plate 56 so that a box blank advanced by feed roller 42 and positioned by guide plate 56 can be fed into the nip between loader rollers 58 and 60 and further advanced by the rotating loader rollers. In a presently preferred embodiment of the invention, loader rollers 58 and 60 are continuously turning, but feed roller 42 rotates intermittently, the rotation being controlled by a pair of microswitches (not shown) tripped by a separated and advanced box blank B. Loading plate 62 is positioned in a 90° arc by a means (not shown) that is also intermittently operated in a timed sequence so that loading plate 62 is in a horizontal position to receive a box blank fed by loader rollers 58 and 60 and is rotated into a vertical position once the box blank has been received.

Transporting means 32 comprises a plurality of transport screws, the number of transport screws depending upon the particular embodiment of the invention, and a means for synchronously rotating the plurality of transport screws (the rotating means not being shown). In the present embodiment of the invention shown in FIG. 2, two pairs of transport screws are depicted, an upper pair of transport screws 64 and a lower pair of transport screws 66. The individual transport screws in the upper and lower pairs are spaced an equal distance apart in a horizontal transverse direction a sufficient distance such that folded box blanks B can fit between the threads, designated by numeral 68, of the corresponding transport screw. The form of thread 68 should be such that box blanks B can be maintained in a substantially perpendicular position to the axis of the respective transport screws.

Figures 3A, 3B, 3C, 3D, 3E:
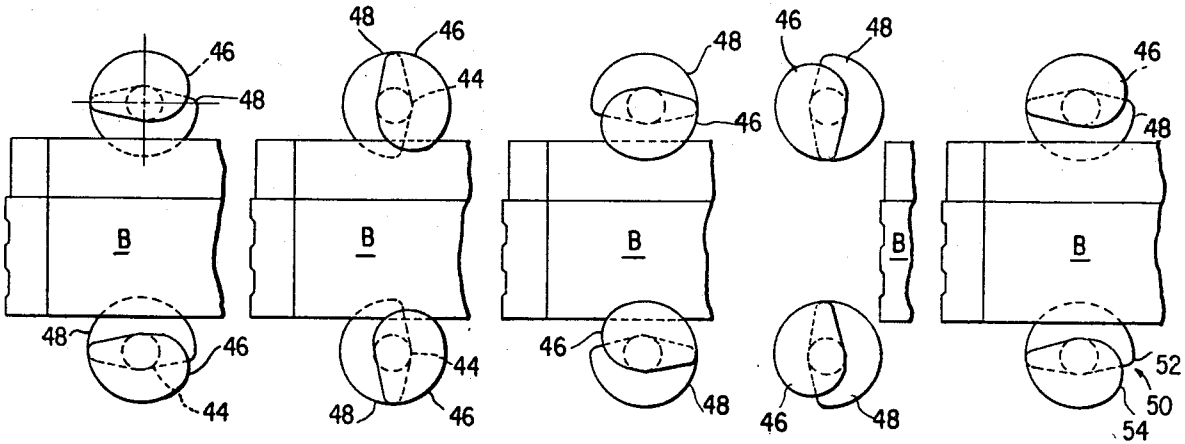
FIGS. 3A–3E and 4A–4E are a plan view and a side elevational view, respectively, of a box blank separator for separating and advancing the lower box blank in a stack of box blanks, each figure consisting of five parts and each part showing the various stages of the separator.
Figure 4A:
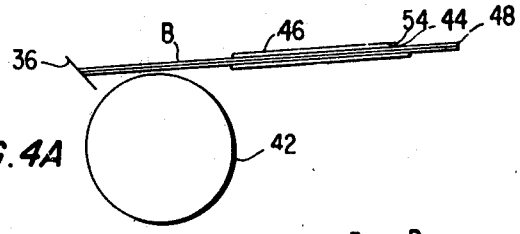
Figure 4B:
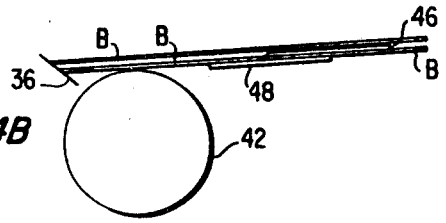
Figure 4C:
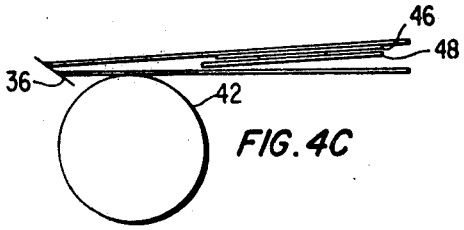
Figure 4D:
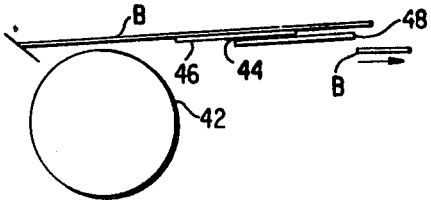
Figure 4E:
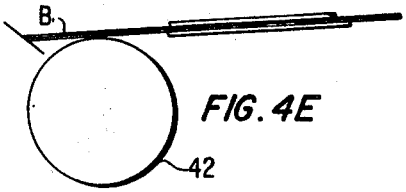

The operation of the supplying means 22 of carton forming apparatus 20 provides a continuous supply of folded box blanks B one at a time to cam means 24. A continuous supply of folded box blanks B is kept in magazine 30 which acts as a temporary storage area and which initially aligns the folded box blanks. The vibrating back 36 of magazine 30 ensures that the stack of box blanks moves slowly down the angled back 36 as the individual box blanks are fed from magazine 30. In addition, the vibrating back 36 of magazine 30 ensures that the bottom box blank B in the stack is kept in contact with disc means 40. When a box blank is needed, discs 46 and 48 are rotated. As clearly shown in FIGS. 3 and 4, the stack of box blanks B is initially supported by the middle portion of the pair of bottom discs 48. As axle 44 is rotated, end section 54 of the pair of top discs 46 move between the two bottommost box blanks B. Because the spacing between discs 46 and 48 is substantially equal to the thickness of a folded box blank and because end section 54 is inclined, top disc 46 can easily separate the bottommost box blank from the next box blank in the stack. As shown in FIG. 3B, discs 46 and 48 have been rotated 90° and the bottommost box blank B is supported by end section 52 of bottom disc 48 and the remainder of the stack of box blanks is supported by end section 54 of top disc 46. It is noted that the separating process is further aided by the fact that back 36 of magazine 30 is slanted and hence the weight of the entire stack is not placed directly above discs 46 and 48. FIGS. 3C and 4C show discs 46 and 48 in the 180° position whereby the bottommost box blank B has been released and lowered onto feed roller 42. The stack of box blanks are still supported by top disc 46. Upon the lowering of the former bottommost box blank B onto feed roller 42, the drive means (not shown) for feed roller 42 is energized and the box blank is advanced away from magazine 30 as shown in FIGS. 3D and 4D. FIGS. 3E and 4E depict the disc means 40 back in its initial starting position with the stack of folded box blanks again being supported by bottom discs 48. Thus, the bottommost box blank B in the stack is separated and advanced from magazine 30 with only one complete revolution of disc means 40.

The advanced box blank B is positioned by guide plate 56 into the nip between continuously rotating loader rollers 58 and 60. A microswitch (not shown) which has been tripped by the advancing box blank B provides a signal for the stopping of feed roller 42. The advancing box blank is further advanced by rollers 58 and 60 onto loading plate 62 which has been previously positioned into the first, horizontal position. As box blank B is being loaded onto loading plate 62, the box blank B trips a microswitch or (not shown) other detecting means which in turn provides a signal for causing the activation of the loading plate positioning means (not shown). Loading plate 62 is then positioned into the second, vertical position where the box blank is received by transport screws 64 and 66. The transport screws 64 and 66 are then rotated one revolution and the loaded box blank B is received by threads 68 of the transport screws. Loading plate 62 is then returned to the first, horizontal position for accepting another box blank. Transport screws 64 and 66 advance the loaded box blanks B into the box opening cam means 24.

CAM MEANS

A means for opening a folded box blank is in general comprised of at least one cylindrical cam having a spiral cam surface for engaging one of the sides of folded box blank B. Four embodiments of cams in accordance with the present invention are disclosed in FIGS. 5 through 9 and are described in greater detail hereinbelow.

With respect to FIG. 5, cam means 24 is comprised of a single elongated disc cam 70 having an axially progressing, spiral cam surface 72 having a radial distance from the axis of rotation of cam 70 that increases as a function of an increasing distance along the axis of rotation. Cam 70B is described in greater detail in the copending parent application identified hereinabove. As folded box blank B is being opened, the side of the box blank in engagement with cam surface 72 moves axially along cam surface 72 as cam 70 is rotated. The other side of the folded box blank B is retain in the same axial location at the end of the corresponding transport screw.

Figures 5A, 5B, 5C, 5D, 5E, 6A, 6B, 6C, 6D, 6E:
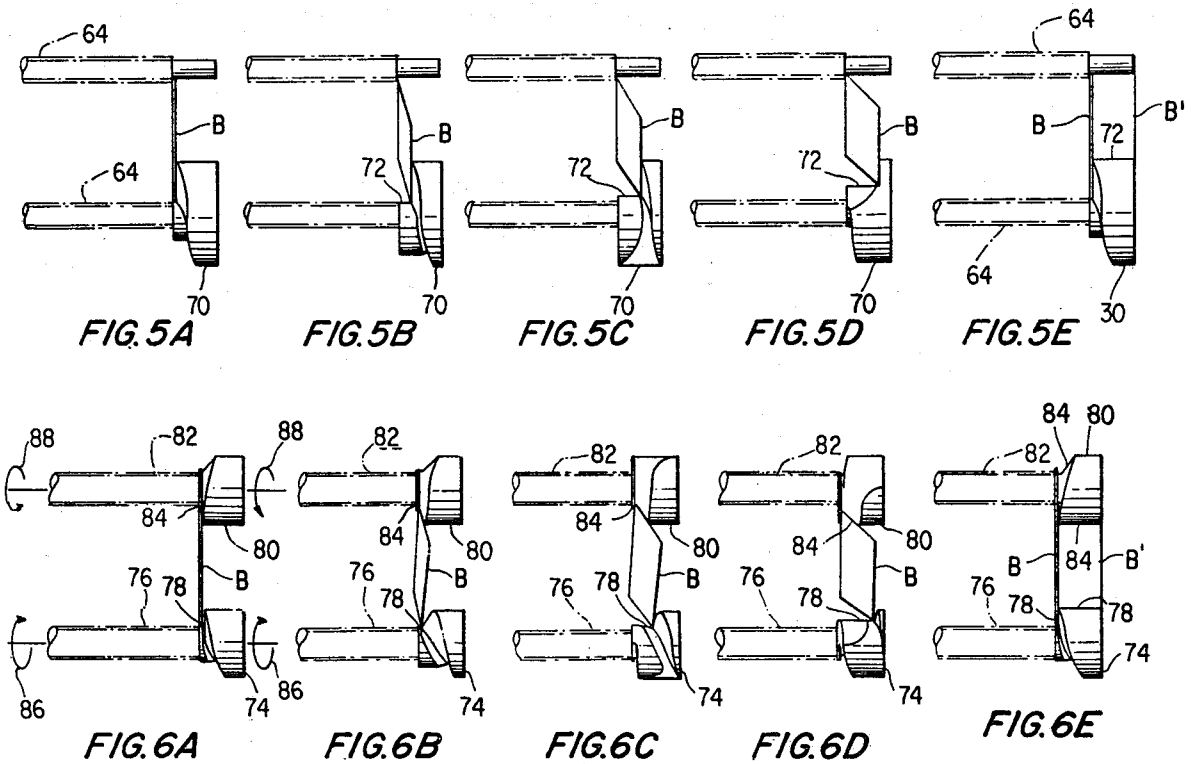
FIGS. 5A–5E are a plan view of a box blank opening cam of the embodiment of the invention shown in FIG. 1 and consists of five parts, each part showing various positions of the cam and of the box blank being opened.
FIG. 6A–6E are a plan view of a box blank opening cam means in accordance with a further embodiment of the invention and consists of five parts, each part showing various positions of the cam and of the box blank being opened.

The opening of a folded box blank B by cam 70 is shown at various stages in FIGS. 5A through 5E wherein cam 70 is shown at positions of 0°, 90°, 180°, 270°, and 360° respectively. The transport screws 64 and 66 axially and longitudinally transport the folded box blanks B and supply them one at a time to cam 70 located at the end of one of the upper transport screws 64, when cam 70 is in the 0° position. The edge of box blank B in contact with the transport screw 64 having cam 70 attached thereto can continue to move in a longitudinal direction on cam surface 72. On the other hand, the opposite side of box blank B, which is in contact with the other upper transport screw 64, is retained and held at the end thereof where threads 68 terminate. Cam surface 72 has a shape so that folded box blank B is completely opened upon one revolution of cam 70. As can be seen in FIGS. 5A through 5E, as cam 70 rotates, the distance between cam surface 72 and the other upper transport screw 64 diminishes. Consequently, box blank B is being slowly compressed at the two opposite folded edges thereof. Since cam surface 72 also progresses in an axial direction as the radial distance of cam surface 72 from the axis of rotation increases, the edge of box blank B in contact with cam surface 72 is forced in an axial direction and is maintained in contact with cam 70 at the vertex between cam surface 72 and the radial edge of cam 70 that defines the end of cam surface 72. As stated above, the opposite side of box blank B in contact with the other transport screw 64 is retained at the same axial position located at the end of the other transport screw 64. Finally, as shown in FIG. 5E, box blank B' has been completely opened and a second folded box blank B has been supplied by the transport screws 64 and 66 to cam 70.

Figure 7:
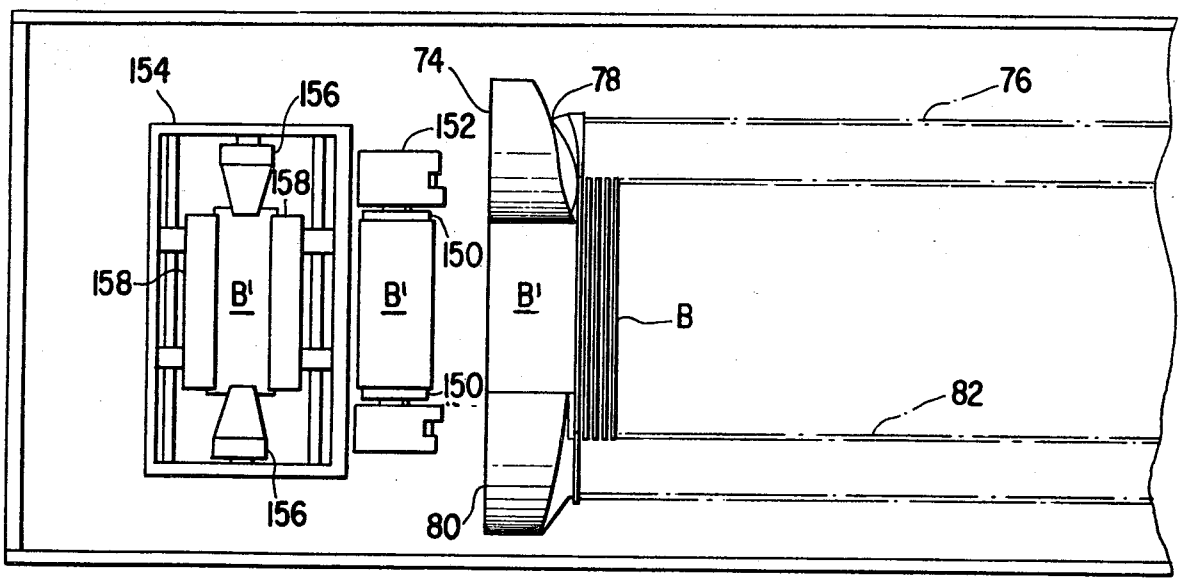
FIG. 7 is a top plan view of part of the embodiment of the invention using the cam means shown in FIG. 6.

A second embodiment of cam means 24 is shown in FIGS. 6 and 7. In the second embodiment, cam means 24 comprises a first cam means for receiving the folded box blanks B and for opening the received box blanks upon the rotation thereof about an axis of rotation and a second cam means for cooperating with the first cam means for opening the received box blanks B one at a time. First cam means comprises a generally cylindrical cam 74 integrally mounted on the end of a first upper transport screw 76. First cam 74 has an axially progressing spiral cam surface 78 that increases in the radial dimension thereof from the axis of rotation as a function of the angle of rotation of first cam 74. The second cam means comprises a substantially cylindrical cam 80 integrally mounted at the end of the other or second upper transport screw 82. Second cam 80 has an axially progressing spiral cam surface 84 which is constant in the axial direction, but which increases in the radial dimension from the axis of rotation as a function of the angle of rotation of second cam 80. A folded box blank B is received at the ends of cams 74 and 80 in contact with transport screws 76 and 82 respectively. Folded box blank B is engaged along both sides thereof by cam surfaces 78 and 84 and is fully opened in one, 360° revolution of cams 74 and 80. Another way of describing cam surfaces 78 and 84 is that the root of first cam 74 moves axially and the root diameter thereof increases radially and the root of second cam 80 does not move axially thereon, but does increase radially. Means (not shown) is provided for synchronously rotating cams 74 and 80 in a clockwise and counterclockwise direction respectively, when viewed from the rearward or distal end of the cams and as shown by arrows 86 and 88 respectively.

Figure 8:
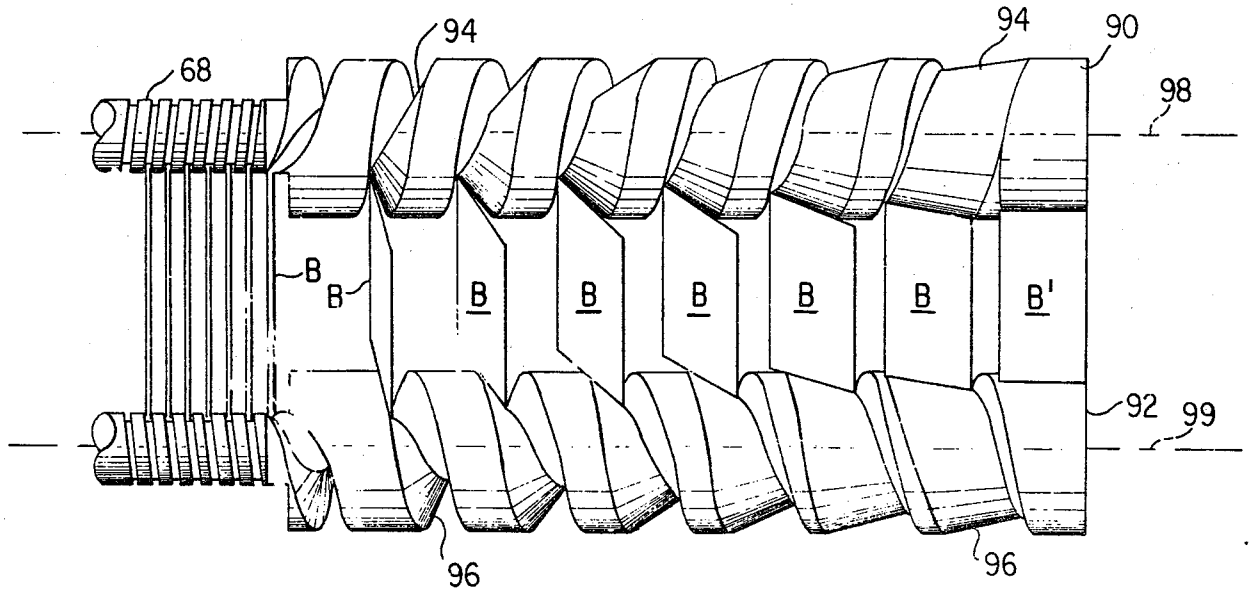
FIG. 8 is a plan view of a further embodiment of the box blank opening cam means in accordance with the present invention.

FIG. 8 depicts a third embodiment of cam means 24 which comprises two multiple revolution box opening cams 90 and 92. Several integral number of revolutions are required to open a folded box blank B using cams 90 and 92 and the entire box blank is advanced longitudinally and axially along cams 90 and 92 as the box blanks are being opened. Cams 90 and 92 comprise axially progressing spiral cam surfaces 94 and 96, respectively. Cam surfaces 94 and 96 are similar and each cam surface increases in the radial dimension from the axis of rotation (shown at 98 and 99 respectively) as a function of the angle of rotation and the axial length of the respective cams. Cam surfaces 94 and 96 have the same radial dimension for the same axial distance along and angular positio of the respective cam. Thus cams 90 and 92 function essentially as an extension of their respective transport screws 100 and 102. In the embodiment of the invention shown in FIG. 8, seven complete revolutions of cams 90 and 92 are required to form an opened box blank B'. Cam surfaces 94 and 96 can also be described as having the root of the cam moving axially as the root diameter increases radially.

Figure 9:
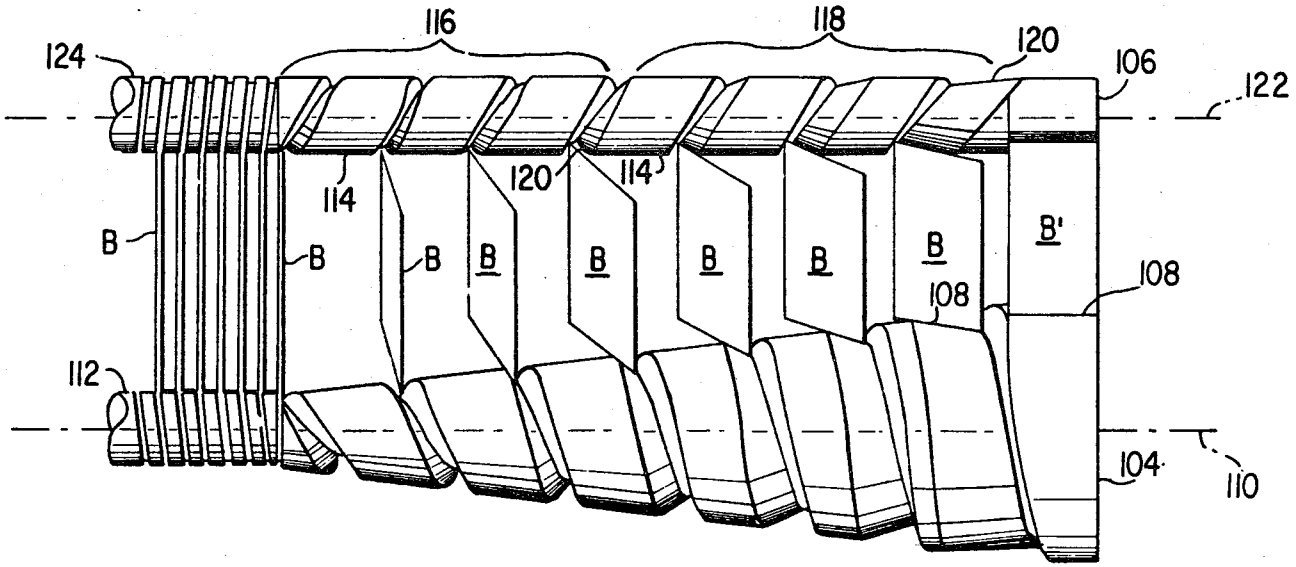
FIG. 9 is a plan view of yet another embodiment of the box blank opening cam means of the invention.

With reference to FIG. 9, a fourth embodiment of cam means 24 is depicted. In this embodiment, cam means 24 comprises a generally truncated conical cam 104 for engaging one edge of the box blank B and a cylindrical cam-like transport screw 106 for engaging the other edge of box blank B. Cam 104 has an axially progressing spiral cam surface 108 that increases in the radial direction from the axis of rotation 110 as a function of the angle of rotation and of the axial distance along cam 104. Cam surface 108 generally conforms to the shape of the side of box blank B as opened box blank B' is being formed. Another way of describing cam surface 108 is that the root of cam 104 moves axially as the root diameter of the cam increases radially. Conical cam 104 essentially forms an extension of and is integral with transport screw 112. Cam-like screw 106 engages the other edge of the folded box blank B and includes threads 114 having a pitch that increases in a first axial portion 116 and then is constant in a second axial portion 118 of cam-like screw 106. Cam-like screw 106 has a thread surface 120 which spirally increases in the axial direction and is constant in the radial distance from an axis of rotation 122 of cam-like transport screw 106 so as to conform to and engage the side of the box blank B during the opening of the box blank. Cam-like screw 106 is integrally mounted to and essentially forms an extension of its respective transport screw 124 and has substantially the same diameter as the diameter as transport screw 124. Threads 114 of cam-like screw 106 can also be described as having a root diameter which remains constant and a thread profile that changes with the axial distance along screw 106. In this embodiment of cam means 24, several revolutions of cam 104 and screw 106 are required to open a box blank B. In the embodiment shown in FIG. 9, a box blank is fully opened in seven complete revolutions of cam 104 and cam-like screw 106.

DEPOSITING MEANS

Depositing means 26 deposits a flexible bag or package P into an opened box blank B' and is depicted in FIGS. 1, 2, 7, and 11. The depositing means 26' comprises lifting means 130 for receiving an open box blank B' from cam means 24 and lifting box blank B' into position under a bag forming and filling apparatus 132, flap spreader means 134 for opening and holding open the end flaps of box blank B', and rotating means 136 for rotating the bag-filled box blank B' to a horizontal position and for depositing the box blank on the box closing and sealing means 28.

A typical opened box blank B' is shown in FIG. 1. Opened box blank B' is a hollow rectangular parallelpiped having front and back panels 140 and 141, respectively, side panels 142, and foldable end flaps, generally designated 143, at both ends. End flaps 143 include two dust flaps 144, which are extensions at each end of both side panels 142, and include seal end flaps 145, which are extensions at each end of front and back panels 140 and 141. When an opened box blank B' is presented to bag forming apparatus 132 for receiving a formed, flexible bag P, it is necessary to ensure that end flaps 143 do not block the path of travel of the bag P being inserted into box blank B'.

Bag forming apparatuses are conventional and in general form a flexible pillow-type bag from a continuous roll of sheet material (not shown). The sheet material is usually formed into a cylinder by overlapping and sealing together the two side edges. A sealing jaw, depicted at 146 in FIG. 1, flattens out and seals one end of the formed cylinder to make a container. The container is then filled with a product, the formed cylinder is advanced downward relative to sealing jaws 146 and sealing jaws 146 flatten out and seal a top portion of the container to complete the bag forming process. Examples of a bag forming apparatus 132 usable with the present invention are disclosed in the Leasure patents, identified in the background of the invention hereinabove and incorporated by reference herein.

Figure 11:
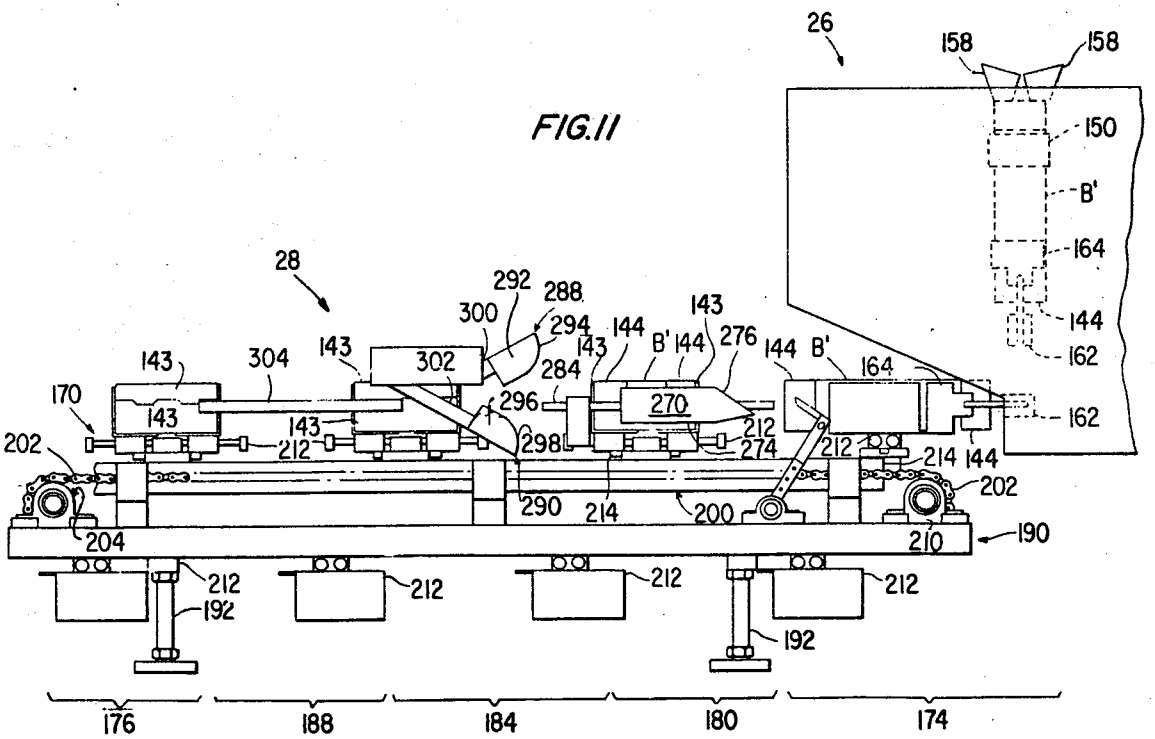
FIG. 11 is a side elevational view of the parts of the embodiment of the invention shown in FIG. 10.

With reference to FIGS. 2, 7, and 11, lifting means 130 comprises fluid operated, transversely movable clamps 150 slidably mounted in a housing 152, means (not shown) located in housing 152 for positioning clamps 150 into and out of engagement with side panels 142 of box blank B' near the top thereof, and means (not shown) for positioning clamps 150 to a first lower position (shown in phantom in FIG. 2) for receiving the opened box blank B' from cam means 24 and for lifting box blank B' to a second upper position under bag forming apparatus 132. In the presently preferred embodiment of the invention, housing 152 travels at an angle upwardly and downwardly between its two positions so that both vertical translation and longitudinal translation of housing 152 can be easily accomplished by a simplified moving means.

Flap spreader means 134 comprises a mounting frame 154, flexibly mounted guides 156 mounted at opposite transverse sides of frame 154 for spreading dust flaps 144, and flexure mounted, fluid operated guides 158 mounted on frame 154 for spreading the top seal end flaps 145.

Rotating means 136 grasps the opened box blank B' after the positioning thereof to the second position under the bag forming apparatus 132 by lifting means 130. Rotating means 136 is comprised of an expansible U-shaped support collar 160 a mounting frame (not shown), a means for expanding support collar 160 (not shown) and a means for rotating support collar 160 from a vertical position to a horizontal position (not shown). Support collar 160 is comprised of a lower support bar 162 and two, transversely movable grasping arms 164 for grasping box blank B' along the lower portions of side panels 142. Support bar 162 of support collar 160 also holds the bottom of box blank B' to retain the received bag P within the box blank.

In operation, lifting means 130 travels down an angle and picks up the formed box blank B' with fluid operated clamps 150. Lifting means 130 together with box blank B' is then lifted upwardly at an angle into position under bag forming apparatus 132. As box blank B' is lifted upwardly to the uppermost position thereof, the end flaps 143 of box blank B' come into engagement with guides 156 and guides 158 of flap spreader means 134. Guides 158 are then rotated outwardly a small amount to spread apart seal end flaps 145 and to present an inner surface thereof to a bag P being dropped downwardly, the inner surfaces of guides 158 guiding the dropped bag P into box blank B'. Just prior to the dropping of bag P, rotating means 136 travels upwardly whereupon support bar 162 thereof engages the bottom of box blank B'. Grasping arms 164 are then moved into engagement with the bottom sections of side panels 142 of box blank B'. When bag P is in box blank B', clamps 150 of lifting means 130 are disengaged and the rotating means 136 is lowered to its bottommost position. Upon reaching its bottommost position, rotating means 136 is rotated until it is in a horizontal position whereupon grasping arms 164 are moved outwardly to disengage from the bag filled box blank B'. The box closing and sealing means 28 now receive box blank B' and close and seal end flaps 143 to produce the final sealed cartion B".

BOX SEALING AND CLOSING MEANS

Figure 10:
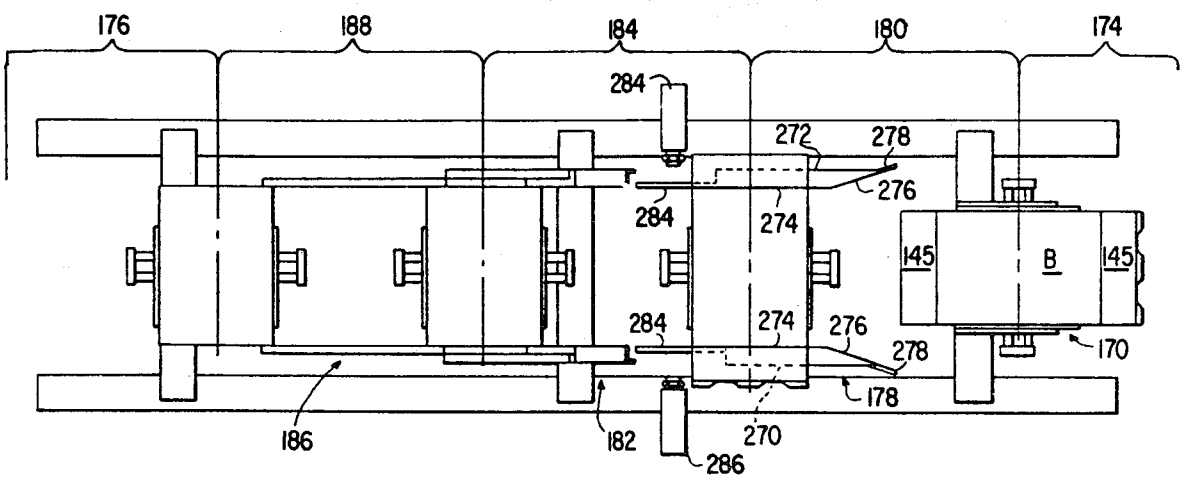
FIG. 10 is a plan view of the means for closing and sealing the ends of a filled box blank in accordance with the embodiment of the invention shown in FIG. 1.

Box closing and forming means as shown in FIGS. 1, 10, and 11, is comprised of a carrier means 170 for receiving the bag-filled box blank B' from depositing means 26, for securely holding box blank B', and for delivering a sealed box blank B" and a conveyor means 172 for conveying carrier means 170 to a plurality of longitudinally spaced, in-line stations, including a receiving station 174 for receiving box blank B' and a delivering station 176 for delivering a sealed box blank B". Box closing and forming means 28 further comprises dust flap closure means 178 located at a second station 180, a seal end flap closure means 182 located at a third station 184, and a sealing means 186 located at a fourth station 188. The various components of box closing and forming means 28 are mounted on a single elongated frame 190 which is in turn mounted on four legs 192.

Conveyor means 172 comprises a rotatable endless conveyor 200 that is in turn comprised of two endless chains 202, a rotatable end sprocket 204 with sprocket wheels 206 and 208 for engagement with corresponding chains 202, and a driving end sprocket 210 for rotating and supporting chains 202 at the other end thereof. Conveyor 200 is continuously operated by a drive means (not shown).

Carrier means 170 is comprised of a plurality of identical carriers 212 that are equally spaced around and rigidly attached to endless conveyor 200. In the embodiment shown in the drawings, carrier means 170 is comprised of eight identical carriers 212 and thus eight sealed box blanks B″ can be produced for each complete revolution of conveyor 200. Carrier 212 is depicted in greater detail in FIGS. 12 and 14. In general, carrier 212 comprises a non-rotatable frame 214 rigidly mounted to and supported by conveyor 200, a carrier tray 216 rotatably mounted on frame 214 for receiving the bag filled box blank B′, and a means 218 for rotating carrier tray 216. Carrier tray 216 is positioned longitudinally parallel to conveyor 200 for receiving a bag-filled box blank B′ and for delivering a sealed box blank B″, and is positioned transversely for presenting end flaps 143 to the various stations for closing and sealing the end flaps.

Figures 12, 13, 14, 14A:
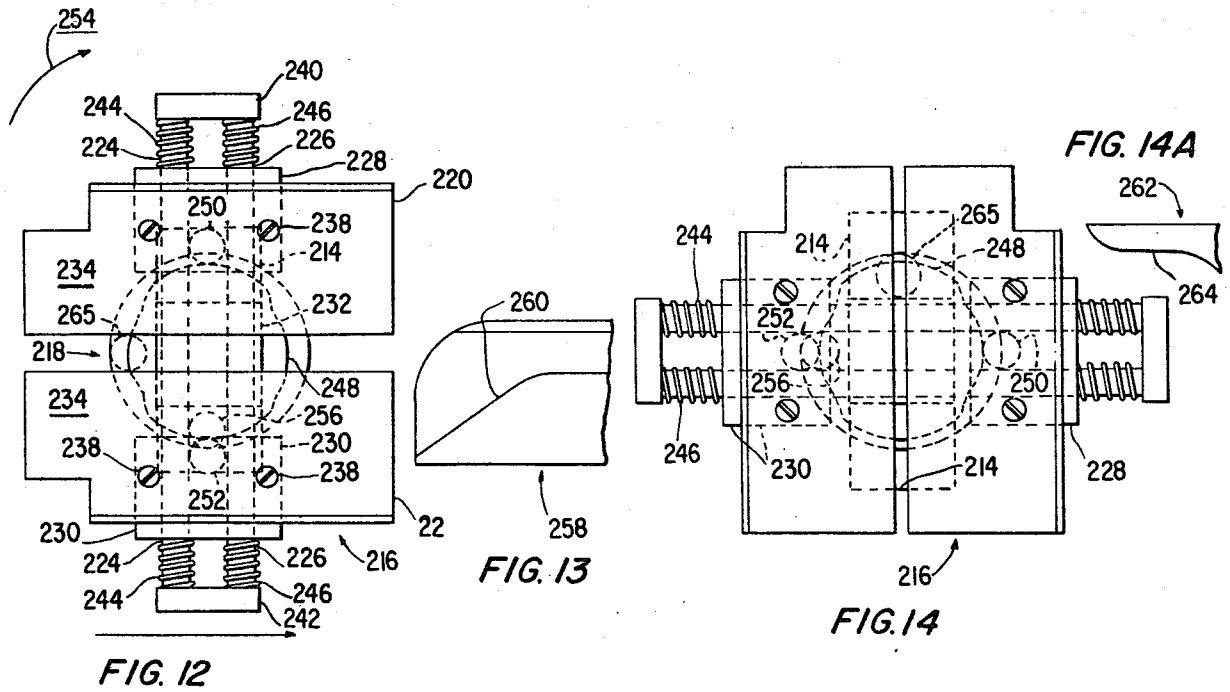
FIGS. 12, 13, 14, and 14A are a series of figures depicting the relative location of a plurality of elements shown in FIG. 11.
Figure 15A:
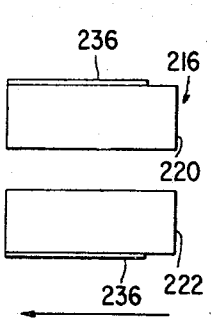
FIGS. 15A–15D are a schematic plan view of the carrier tray shown in FIG. 12 and consists of four parts, each part showing the various positions of the carrier tray as it is being rotated.
Figure 15B:
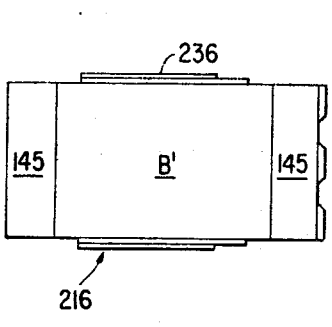
Figure 15C:
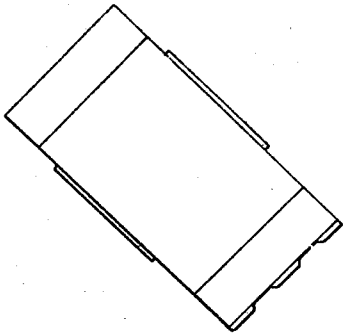
Figure 15D:
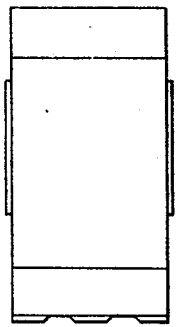

With particular reference to FIGS. 12 and 14, carrier tray 216 comprises two generally horizontal tray sections 220 and 222, elongated cylindrical support rods 224 and 226, bearing blocks 228 and 230 for slidably mounting tray sections 220 and 222, respectively, on support rods 224 and 226, and a central bearing member 232 for rotatably mounting carrier tray 216 onto frame 214. Each tray section 220 and 222 includes a horizontal plate 234 and a vertical back 236. Bearing blocks 228 and 230 are rigidly mounted to the bottom of the corresponding plate 234 of tray sections 220 and 222 with securing means such as screws 238. Rigidly mounted onto the ends of support rods 224 and 226 are two end plates 240 and 242 for keeping the support rods in proper alignment and further for providing a backing surface for two pairs of coil springs 244 and 246 concentrically mounted, respectively, around each end of support rods 224 and 226. The other ends of springs 244 and 246 bear against the end of bearing blocks 228 and 230 for resiliently urging tray sections 220 and 222 toward each other. Thus, when a bag filled box blank B′ has been delivered to carrier 212, the box blank B′ can be securely held in place on top of carrier tray 216 by tray section backs 236 which resiliently engage corresponding side panels 142 of the box blank B′.

Tray sections 220 and 222 are positioned between a first open position (shown in FIG. 12) and a second closed position (as shown in FIG. 14) by a cam and cam follower means. A generally oblong disc cam 248 is rigidly attached on top of frame 214 between central bearing member 232 and frame 214. Elongate cylindrical cam followers 250 and 252 are rigidly attached at one end thereof to and depend downwardly from the bottom of bearing blocks 228 and 230, respectively. Cam followers 250 and 252 are kept in engagement with disc cam 248 by springs 244 and 246. Thus, as clearly shown by FIGS. 12 and 14, when carrier tray 216 is rotated in the direction shown by arrow 254 from a first position shown in FIG. 12 to the second position shown in FIG. 14, disc cam 248 remains stationary and cam followers 250 and 252 follow the cam surface of disc cam 248. Tray sections 220 and 222 are forced toward one another by springs 244 and 246 as cam followers 250 and 252 follow a cam surface having a decreasing radius.

Rotating means 218 for selectively rotating carrier tray 216 from the aforementioned first, open position to the second, closed position comprises a cylindrical depending cam follower schematically shown at 256. Cam follower 256 is rigidly attached to carrier tray 216 so that when cam follower 256 engages an appropriate cam surface, carrier tray 216 will be rotated with respect to frame 214. The cam surfaces for engaging cam follower 256 are schematically shown in FIGS. 13 and 14A. It is noted that the series of Figures, FIGS. 12, 13, 14, and 14A, are shown schematically in their relative longitudinal and transverse positions. A first, elongate carrier tray positioning cam 258 having an outer cam surface 260, shown in FIG. 13, is for rotating carrier tray 216 clockwise as shown in the Figures from the first position to the second position. Elongate cam 258 is located at receiving station 17 and is mounted (not shown in FIG. 11) to frame 190 between conveyor chains 202. Thus, as a carrier 212 enters receiving station 174, carrier tray 216 is in the first, opened position with tray sections 220 and 222 aligned parallel to conveyor chains 202. As carrier 212 is moved through receiving station 174, a box blank B′ is placed on carrier tray 216 by depositing means 26. As carrier 212 is conveyed out of receiving station 174, cam follower 256 engages elongate cam 258 and upon further longitudinal movement of carrier 212 with respect to elongate cam 258, cam follower 256 is guided along cam surface 260, thereby rotating carrier tray 90° to the second, closed position. Hence, as carrier 212 is conveyed to second station 180, carrier tray 216 has been rotated such that tray section 220 and 222 are positioned in a transverse direction with the tray sections being forced closer together by springs 244 and 246.

A second elongate cam 262 is rigidly mounted to frame 190 at delivery station 176. Elongate cam 262, shown in FIG. 14A, has a cam surface 264 that is the functional opposite of cam surface 260 so that elongate cam 262 rotates carrier tray 216 in the counterclockwise direction back to the position of carrier tray 216 shown in FIG. 12. The interaction of cam follower 256 with cam 262 and the resultant rotation of carrier 212 is similar to that described above regarding elongate cam 258. Obvious means such as springs and engaging disc cams can be further employed to ensure the positive rotation of carrier tray 216 between the first and second positions thereof. Furthermore, stop means can be used to ensure that carrier tray 216 does not overshoot the desired rotational position thereof. These and other means to ensure effective positioning of carrier tray 216 are conventional and well known and need not be described in further detail herein.

Figure 16A:
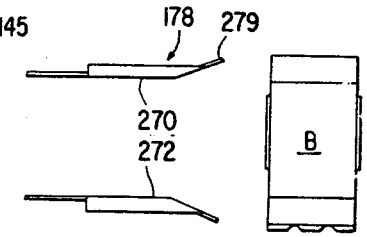
FIGS. 16A–16D are a schematic plan view of a means for tucking in the dust flaps of an open box blank and consists of four parts, each part showing the various positions of the tucking operation.
Figure 16B:
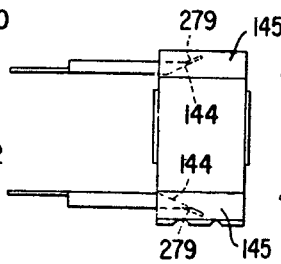
Figure 16C:
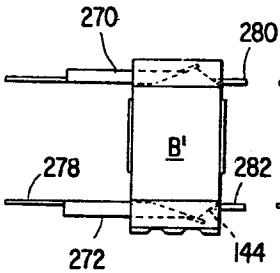
Figure 16D:
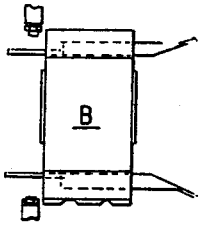
Figure 17A:
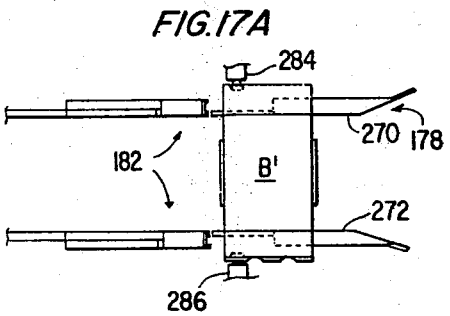
FIGS. 17A–17D are schematic plan views of a means for applying glue to the seal ends of a box blank and for closing the seal ends and consists of four parts, each part showing various positions of the means for applying glue and for closing the seal ends.
Figure 17C:
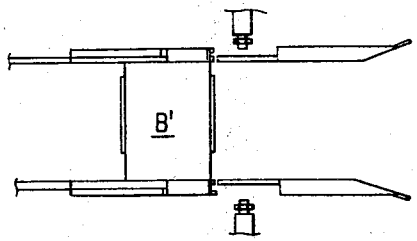
Figure 17B:
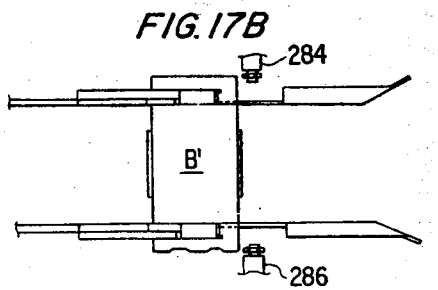
Figure 17D:
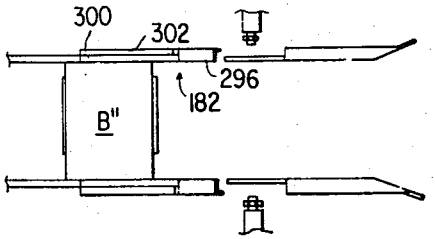

A sealed box blank B″ is produced in the second through fourth stations of box closing and forming means 28. At second station 180, dust flap closure means 178 tuck in and close dust flaps 144 of box blank B′. Dust flap closure means 178 comprises a first pair of stationery tucking members 270 and 272 for tucking in the leading dust flaps of box blank B′. Tucking members 270 and 272 are rigidly mounted onto frame 190 on either side of endless conveyor 200. In the embodiment of the invention depicted in FIGS. 10 and 11, tucking members 270 and 272 include a platelike main body 274 and an integrally attached, triangularly shaped in elevation forward section 276. In plan view as shown in FIG. 10, it could also be seen that forward section 276 is comprised of an inclined ramp for gradually engaging dust flaps 144. A pair of parallelly spaced, horizontally extending guide rails 278 having outwardly slanted forward guide rail extensions 279 are mounted on frame 190 just inside first tucking members 270 and 272. Guide rail extensions 279 initially engage box blank B′ and center the box blank on carrier tray 216 as carrier 212 is conveyed through station 180. Dust flap closure means 178 further comprises a second pair of dust flap tucking members 280 and 282. Tucking members 280 and 282 each comprises an inverted L-shaped member pivotably mounted at the lower end thereof to frame 190. Tucking members 280 and 282 are automatically rotated by fluid means (not shown) when carrier 212 reaches a certain location in second station 184. In one embodiment, the rotation of tucking members 280 and 282 is initiated by a microswitch (not shown) that is tripped by carrier 212. The longitudinal position of carrier 212 when second tucking members 280 and 282 are rotated, is such that the bases of the members engage (as shown in FIG. 16C) the rear dust flaps 144 of box blank 1 and hold the rear dust flaps in place until box blank B' has been advanced sufficiently that the tucked in dust flap is also engaged by guide rail extensions 279 of guide rails 278. The main section of guide rails 278 engage the corresponding ends of box blank B' between the open seal end flaps 145 and hold dust flaps 144 in the tucked in position as box blank B' is conveyed to the third station 184. Located at the beginning of the third station 184 are a pair of hot melt glue applicators 284 and 286. Glue applicators 284 and 286 apply a string of glue to the bottom seal end flap and apply a dot of glue to each end of the top seal end flap respectively. If desired, additional glue applicators can be provided to apply glue to both inside and outside seal end flaps 145.

Seal end flap closure means 182 comprise upper and lower sheet metal guides 288 and 290. Guides 288 and 290 are mounted onto frame 190 at either side of conveyor 200 and engage first the uppermost seal end flap first and then the bottommost seal end flap for closing the respective flaps in the desired order. Guide 288 comprises a blade section 292 having a blunt, downwardly curved, convex leading edge 294. The lower guide 290 has a similar blade section 296, but with an upwardly curved, blunt, convex leading edge 298. Guides 288 and 290 each respectively comprise elongate guide bars 300 and 302 mounted at the rearward ends thereof to frame 190 and rigidly attached to and supporting blade sections 292 and 296, respectively, at the other end thereof. As can be seen in FIG. 10, guides 288 and 290 are located on either side of conveyor 200 and are positioned so as to engage the outwardly extending seal end flaps at the top and bottom of box blank B'. Guide bars 300 and 302 finish closing seal end flaps 145 of box blank B' and apply pressure to compress and set the hot melt glue.

Sealing means 186 located at third station 184 thus can be thought of as comprising guide bars 300 and 302. In addition, sealing means 186 comprises a pair of based elongate parallel pressure bars 304 and 306 which are rigidly mounted on frame 190 on either side of conveyor 200 and just rearwardly of the rearward ends of guide bars 300 and 302. Pressure bars 304 and 306 engage the closed ends of the sealed box blank B" and hold the sealed end flaps 145 thereof in position for a longer period of time as box blank B" is conveyed therealong to ensure the setting of the glue.

As mentioned above, elongate cam 262 is mounted at delivery station 176 for engaging cam follower 256 and for rotating carrier tray 216. As carrier tray 216 is rotated tray sections 220 and 222 are urged apart by the interaction of cam followers 250 and 252 with disc cam 248. Thus, as carrier 212 is conveyed to the end of delivery station 176 and around end sprocket 204, sealed box blank B" is released from carrier 212 and delivered to any desired supporting structure (not shown).

The operation of box closing and forming means 28 is schematically shown in FIGS. 15 through 19. In FIG. 15A, carrier tray 216 is shown in the open, loading position with tray section 220 and 222 spaced apart so that a box blank B' can be inserted in between backs 236, as shown in FIG. 15B. Carrier tray 216 is then rotated 90° and during the rotation thereof, as described hereinabove, tray sections 222 and 224 are urged toward each other with backs 236 engaging the sides of box blank B'. Thus, carrier tray 216 clamps box blank B' as carrier tray 216 is rotated by the camming action between elongate cam 258 and cam follower 256. FIG. 16 depicts the operation of dust flap closure means 178. As box blank B' engages dust flap closure means 178, box blank B' is positioned on carrier tray 216 by guide rail extensions 279 and the leading dust flaps 144 are folded inwardly. The folding operation of the leading dust flaps 144 continues as box blank B' is moved longitudinally into tucking members 270 and 272 shown in FIG. 16C. The rear dust flaps are then tucked in by the operation of pivotable second, tucking members 280 and 282. The tucking of the rear dust flaps is timed so as to tuck the dust flaps under the guide rail extensions 279, which then holds both tucked in dust flaps 144 in place, as shown in FIG. 16B. As shown in FIG. 17, with front and rear dust flaps tucked in and seal end flaps extended, box blank B' is advanced toward glue applicators 284 and 286. Hot melt glue is then applied to the insides of the seal ends and the seal ends are folded down by seal end flap closure means 182, shown in FIGS. 17B, and 17C.

Figure 18A:
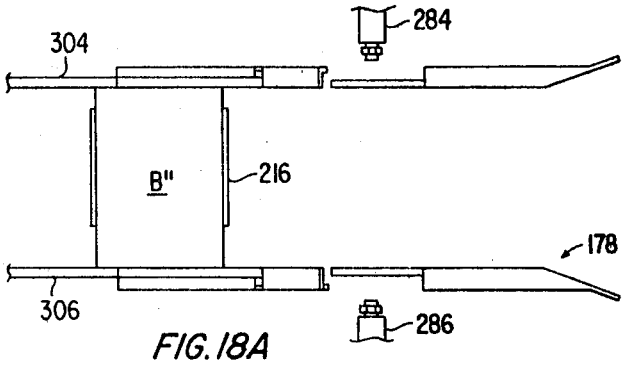
FIGS. 18A–18C are schematic plan views showing means for applying pressure to the ends of the closed and sealed box and consists of three parts, each part showing various relative positions between the pressure means and the box.
Figure 18B:
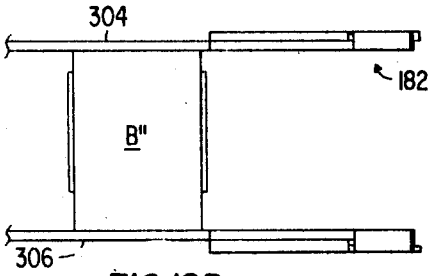
Figure 18C:
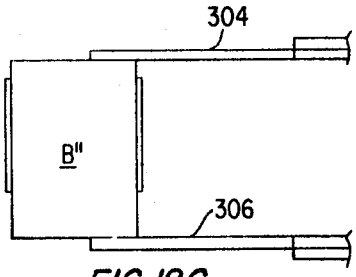
Figure 19A:
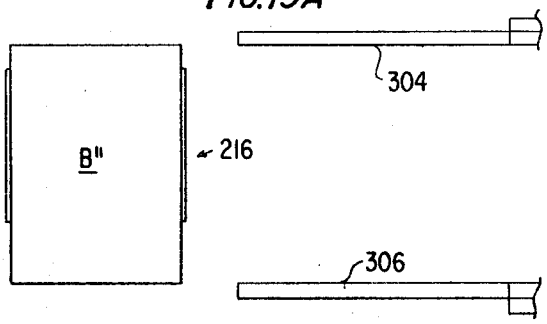
FIGS. 19A–19C are a schematic plan view consisting of three parts showing the carrier tray with a sealed box therein.
Figure 19B:
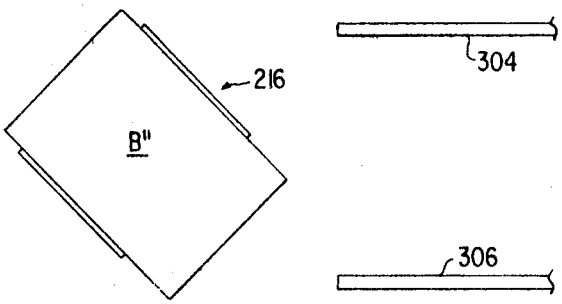
Figure 19C:
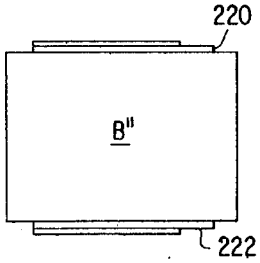

Finally, with reference to FIGS. 18 and 19, the ends of the sealed box blank B" are compressed by pressure bars 304 and 306 so that the seal end flaps 145 are held down giving the adhesive time to set. Thus, the length of pressure bars 304 and the rotational rate of conveyor 200 determine the additional time provided for setting the glue. Finally, as shown in FIG. 19, after sealed box blank B" has been conveyed a sufficient distance away from pressure bars 304 and 306, carrier tray 216 is indexed 90° back to its initial position, thereby opening tray sections 220 and 222 from another. The sealed box blank B" is then discharged from carrier tray 216 which completes one complete cycle of box closing and forming means 28.

Although the invention has been described in detail with respect ot its exemplary embodiments thereof, it will be understood of those of ordinary skill in the art that variations and modifications may be effected within the scope and spirit of the invention.

We claim:

1. A method of forming a bag and box package comprising the steps of forming, filling and sealing a bag, bringing a carton having both ends thereof open into a position beneath the formed, filled and sealed bag, providing a support for the open lower end of the carton, lowering the filled bag into the carton wherein the lower end of the bag is held in a position in alignment with the lower end of the carton by the support, removing the support from the lower end of the carton, and sealing the open ends of the carton with the filled and sealed bag therein.

2. A method of forming a bag and box package comprising the steps of forming, filling and sealing a bag, bringing a carton having both ends thereof open into a position beneath the formed, filled and sealed bag, moving the bag into the carton, moving the carton with bag therein into a horizontal position, and sealing the open ends of the carton.

3. A method according to claim 2 wherein the carton has end flaps which are held open when the filled bag is placed within the carton.

4. A method of packaging comprising the steps of forming an open ended rectangular carton, forming a bag from strip packaging film on a form, fill and seal packaging machine, filling the formed bag, sealing the filled bag, moving the carton having both ends thereof open to a position beneath the filled and sealed bag, placing the bag within the carton, moving the open ended carton with the bag therein to a horizontal position, and sealing both open ends of the carton.

* * * * *